US005354116A

United States Patent [19]

May et al.

[11] Patent Number: 5,354,116

[45] Date of Patent: Oct. 11, 1994

[54] RECLINING CHAIR WITH ARTICULATING LINKAGE FOR PADDED INTERMEDIATE OTTOMAN

[75] Inventors: Teddy J. May, Tupelo, Miss.; Walter C. Rogers, Denton, N.C.

[73] Assignee: The Lane Company, Inc., Altavista, Va.

[21] Appl. No.: 956,078

[22] Filed: Oct. 1, 1992

[51] Int. Cl.[5] ..... A47C 1/02

[52] U.S. Cl. ..... 297/85; 297/70; 297/423.34

[58] Field of Search ..... 297/84, 85, 89, 429, 297/70, 423.34

[56] References Cited

U.S. PATENT DOCUMENTS

| | | | |
|---|---|---|---|
| 2,749,970 | 6/1956 | Quakenbush | 297/84 |
| 2,774,412 | 12/1956 | Luckhardt | 155/110 |
| 2,869,619 | 1/1959 | Petersen et al. | 155/107 |
| 2,871,917 | 2/1959 | Schliephacke | 155/106 |
| 2,879,833 | 3/1959 | Fletcher | 297/89 |
| 2,914,113 | 11/1959 | Fletcher | 155/106 |
| 2,914,114 | 11/1959 | Fletcher | 155/106 |
| 2,966,939 | 1/1961 | Fletcher | 155/106 |
| 3,047,336 | 7/1962 | Schliephacke | 297/85 |
| 3,233,938 | 2/1966 | Fletcher | 297/84 |
| 3,243,225 | 3/1966 | Katz | 297/75 |
| 3,400,975 | 9/1968 | Rogers, Jr. | 297/75 |
| 3,492,049 | 1/1970 | Fletcher | 297/316 |
| 3,547,747 | 11/1970 | Rogers, Jr. | 297/85 |
| 3,767,257 | 10/1973 | Rogers, Jr. | 297/85 |
| 3,880,462 | 4/1975 | Mednick | 297/84 |
| 3,941,417 | 3/1976 | Ré | 297/85 |
| 3,958,827 | 5/1976 | Ré | 297/85 |
| 4,570,996 | 2/1986 | Rogers, Jr. | 297/85 |
| 4,660,883 | 4/1987 | Kowalski | 297/85 |
| 4,669,778 | 6/1987 | Rogers, Jr. | 297/85 |
| 4,674,794 | 6/1987 | Pine | 297/85 |
| 4,826,243 | 5/1989 | Lawson | 297/85 |
| 4,989,914 | 2/1992 | Pine | 297/85 |
| 5,013,084 | 5/1991 | May | 297/85 |
| 5,054,850 | 10/1991 | Pine | 297/84 |
| 5,064,244 | 11/1991 | Sproule | 297/68 |
| 5,090,768 | 2/1992 | Re et al. | 297/85 |
| 5,129,701 | 7/1992 | Pine | 297/84 |
| 5,156,441 | 10/1992 | Byersmith | 297/85 |
| 5,192,113 | 3/1993 | Wiecek | 297/85 |

OTHER PUBLICATIONS

Photograph of Berkline Style No. 131 Recliner Chair, copyright 1989.

*Primary Examiner*—Michael Milano

*Attorney, Agent, or Firm*—Cushman Darby & Cushman

[57] ABSTRACT

A reclining chair is provided with an ottoman (or leg rest) which includes primary (or main) and secondary (or mid or middle) ottoman members separately mounted to pantographic linkage subsystems of the side linkages of the chair-operating mechanism. Both ottoman members are padded and include side skirts for veiling respective portions of the side linkages when the ottoman is in a raised condition. The secondary ottoman is articulated directly to the primary ottoman, for control, so that as the ottoman is being retracted to a stowed position below the front of the seat, the secondary ottoman is rotated from a face-upwards, to a face-rearwards orientation, and received into a pocket formed behind the primary ottoman, which is rotated from a face-upwards, to a face-forwards orientation. By preference, a doubly catenated apron joins the seat and arm frame below the seat cushion at the front of the chair to the rear of the secondary ottoman, and the front of the secondary ottoman, to the rear of the primary ottoman.

11 Claims, 8 Drawing Sheets

RECLINING CHAIR WITH ARTICULATING LINKAGE FOR PADDED INTERMEDIATE OTTOMAN

BACKGROUND OF THE INVENTION

In approximately October of 1989, several recliner chair manufacturers began to offer so-called pad-over-chaise reclining chairs, in which a soft, upholstered pad integrally extended from the primary ottoman (sometimes also referred to as a primary or main leg rest) to the front of the seat cushion. Within a short period of time, these chairs have become very popular. Users report that the continuous support which they provide a user's legs from the seat to the ottoman substantially increases the user's comfort.

In most currently available designs, the pad remains visible when the ottoman is retracted. From a manufacturer's viewpoint, this fact represents a serious styling limitation, as does the fact that each pad-over-chaise recliner must have a similar pad over the seat and ottoman.

Others have attempted to overcome these limitations, by providing altered mounting for a conventional mid-ottoman (sometimes also referred to as a secondary ottoman) so that it moves up higher when the ottoman is extended, e.g., up to a level that is generally coplanar with the seat, so that it provides some support for the rear of the user's leg, between the front of the seat and the rear of the primary ottoman. Such an elevated secondary ottoman may not completely fill the gap between the seat and the primary ottoman, and it does not extend over the side linkages of the chair operating mechanism when the chair is in its TV position (ottoman fully extended, but chair back remaining fully, or nearly fully erect). One manufacturer of such chairs has attempted to hide some of the otherwise exposed side linkages, by providing plastic shields at the sides of the mid-ottoman. In this prior art chair, the mid-ottoman is an upholstered board.

SUMMARY OF THE INVENTION

A reclining chair is provided with an ottoman (or leg rest) which includes primary (or main) and secondary (or mid or middle) ottoman members separately mounted to pantographic linkage subsystems of the side linkages of the chair-operating mechanism. Both ottoman members are padded and include side skirts for veiling respective portions of the side linkages when the ottoman is in a raised condition. The secondary ottoman is articulated directly to the primary ottoman, for control, so that as the ottoman is being retracted to a stowed position below the front of the seat, the secondary ottoman is rotated from a face-upwards, to a face-rearwards orientation, and received into a pocket formed behind the primary ottoman, which is rotated from a face-upwards, to a face-forwards orientation. By preference, a doubly catenated apron joins the seat and arm frame below the seat cushion at the front of the chair to the rear of the secondary ottoman, and the front of the secondary ottoman, to the rear of the primary ottoman.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
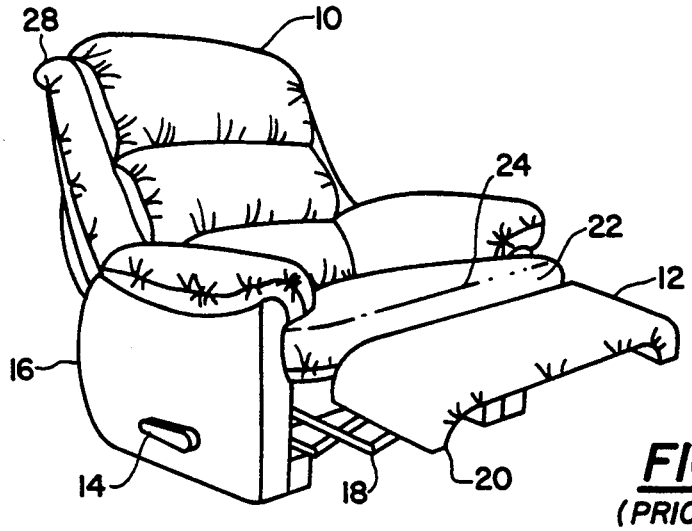
FIG. 1 (PRIOR ART)
FIG. 1 is a small scale perspective view showing a prior art recliner with a unitary ottoman, shown in the TV position of the chair.

In the drawings, the ottoman and ottoman operating linkage system of the invention is shown provided, by way of example, on a particular reclining chair, the remainder of which is conventional (including the remainder of the reclining chair mechanism). Accordingly, the conventional portions of the chair will be only briefly described, simply in order to permit a person of ordinary skill in the art to become properly oriented for understanding the details of the present invention. In fact, the conventional part of the chair may be varied considerably, and yet fully make use of the principles of the present invention.

Figure 2:
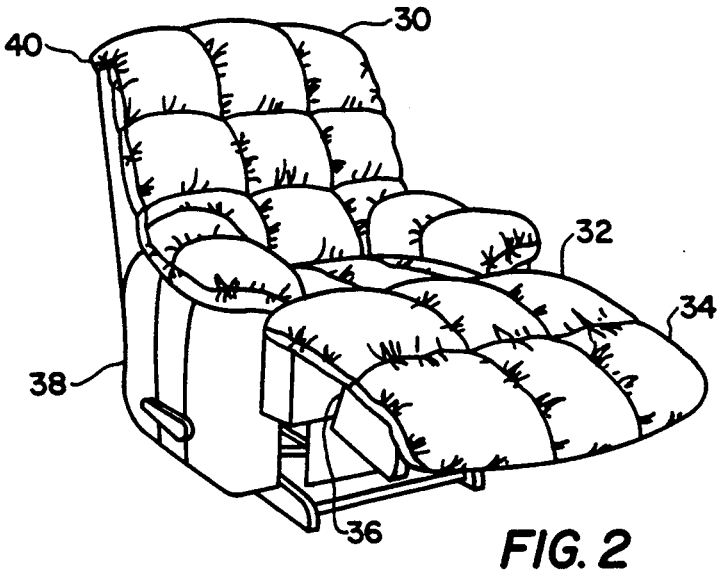
FIG. 2 (PRIOR ART)
FIG. 2 is a small scale perspective view showing a prior art pad-over-chaise type of recliner in the TV position.
Figure 3:
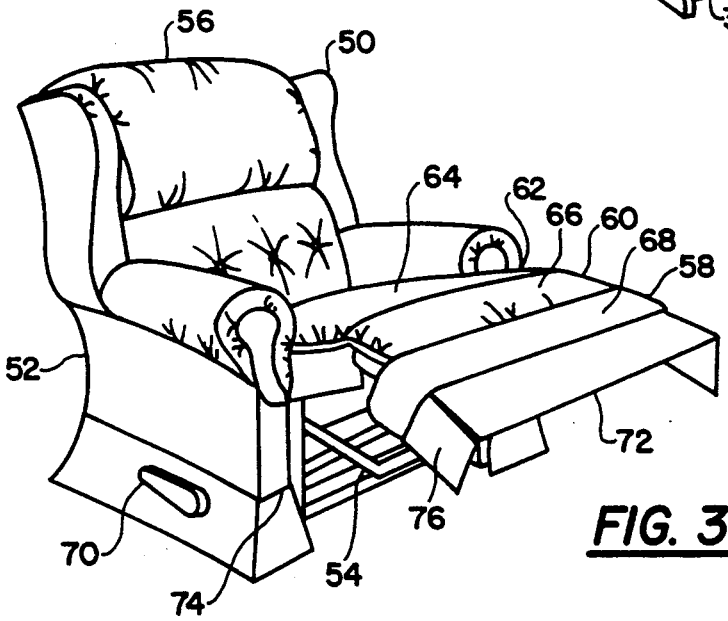
FIG. 3 is a small scale perspective view of a recliner constructed in accordance with the principles of the present invention, with the two-part ottoman shown raised and extended in the TV position of the chair.

FIGS. 1–3 depict, similarly in a TV position (i.e., with the leg rest fully or nearly fully extended, but the chair back remaining fully or nearly fully erect).

The reclining chair 10 depicted in FIG. 1, is shown provided with a conventional one-unit ottoman 12 which, upon rotating of the operating handle 14 by a user, raises and extends the ottoman 12 from a padded face forwards retracted and stowed position under the front of the seat cushion at the front of the seat and arm frame unit 16, to a generally horizontal, padded face upwards position on the pantographic left and right side linkage subassemblies 18 (only the left one of which happens to show in FIG. 1). The padding on the ottoman 12 includes left and right wings 20 which project rearwardly when the ottoman is stowed, and which project downwardly when the ottoman is extended, in both events to help to veil from view some of the mechanical connections and interconnected links of the chair operating mechanism. Particularly as the ottoman is being raised into position and lowered to stow it, and to a lesser extent while the chair is fully in its TV or reclined position, a slot of space, i.e., a gap exists at 22, between the rear of the ottoman 12 and the front edge of the upholstered seat cushion 24 of the chair.

The chair 10 of FIG. 1 can be reclined from the TV position shown in FIG. 1, by the user's pressing forwards on the chair arms 26 and rearwardly on the upper part of the upholstered chair back 28 with their back, thereby causing the chair back reversibly to recline relative to the seat and arm frame unit 16. In many conventional reclining chairs, the reclining of the back is accompanied by an upward and forward movement of the seat and arm frame unit, relative to a fixed base (barely visible in this view), which rests stationarily on the floor (or which, in the case of a swivel reclining chair, rests on the upper, rotatable plate of a vertical axis turntable, the lower, fixed plate of which rests stationarily on the floor). Some conventional reclining chairs such as the one shown in FIG. 1, may include additional features, such as a rocking feature, in which case the seat and arm frame unit includes a rocker, which rests on a platform rocker-type fixed base with rails for the rockers to rock-upon, and conventional balance-springs for tending to return the rockers to a datum position. It is also conventional for the operating mechanisms of such rockers to have a rocker lock subassembly, which works off of the rotatable torque tube to which the operating handle 14 is fixed, for permitting rocking while the chair is fully erect (closed), but preventing rocking as soon as the user, in initiating movement of the chair to its TV position, loses contact of their feet with the floor. That locking effect prevents the user from having the discomforting loss-of-control feeling that continued rockability would provide once the user could no longer control rocking by foot contact with the floor in front of the chair. The conventional rocker lock (which may be of the forward and rear landing-gear type) is not visible in FIG. 1.

Another non-shown feature with which it would be conventional to provide the chair 10, is an apron of upholstery material hanging in a simple catenary from the under/back side of the top/rear of the ottoman, to the seat and arm frame unit at the underside of the front of the seat cushion, for the purpose of functionally and visually occupying the gap 22, both to keep legs, small children and things out of the gap, and for veiling some of the chair operating mechanism from view.

The conventional reclining chair 30 shown in FIG. 2 is similar to the one shown in FIG. 1, except that in place of having an apron of upholstery hanging in a catenary between the ottoman and the front of the seat and arm frame unit, below the front edge of the seat cushion, the padding 32 which is provided on the top/-front of the ottoman 34 is typically thicker than in the FIG. 1 type of conventional reclining chair, and it bridges over the gap at 36, visually unbroken, and continues rearwards, laterally and upwards, as contemporary-style upholstery for the seat and arm frame unit 38 and the chair back 40. Because the padding 32 remains visible in all positions of the chair, designers have been limited as to the styling period they can refer to in providing styling for such chairs. Most, if not all of the reclining chairs of this "pad-over-chaise" type have been provided with contemporary styling. While many customers and potential customers are perfectly pleased with contemporary-style furniture, others are not. So, it has been a heretofore unmet desire of reclining chair designers, to provide a chair having all the comfort advantages of pad-over-chaise-type recliners, but which permit a greater latitude for styling, so that traditional and classical styles of reclining chairs, as well as contemporary and modern styles can be provided on chairs which have the leg support and mechanism-hiding, gap-fitting advantages provided by conventional pad-over-chaise-type recliners.

A reclining chair 50, embodying principles of the present invention, is shown somewhat schematically in its TV position, in FIG. 3. Although the details are not visible in this view, the chair 50 may be provided with any of the above-described elaborations of conventional recliners, e.g., it may have a platform rocker feature with a rocker lock, or it may be stationary on the floor, it may have a swivel or swivel/rocker base. Although it is shown being handle operated, its mechanism could be motorized by conventional means. None of such elaborations would necessarily alter or detract from the novel features that will be described below with relation to the drawing FIG. 4 et seq.

Some conventional chairs which have extensible-retractable leg rests have chair backs which are fixed in relation to their seat and arm frame units. Such chairs have only a closed position and a TV position, but no fully reclined position. Although it is not preferred, the present invention can be put to use on such a chair. Such a chair is therefore meant to be encompassed within the meaning of the term "reclining chair" (and its synonym "recliner") as used in this document.

Recently, it has become conventional to provide a reclining chair as a unit of a sofa, such as at the end of an L-shaped sectional sofa, or at both ends, or to provide two independently operable recliners, side-by-side, on a common base, with a table/arm rest unit between them. The present invention can be put to use on such articles of seating furniture (which, therefore, are meant to be encompassed within the meaning of the word "chair" as it is used in this document).

Before proceeding further with the detailed description, two general observations are provided.

First, for orienting the reader, a broad overview is given as to the chair depicted in FIG. 3. The chair 50 includes an upholstered seat and arm frame unit 52 mounted on a base (not visible in this view) by a mechanism 54 (most of which is not visible in this view). An upholstered chair back 56 is also mounted to the mechanism as is an ottoman (or leg rest), which includes a primary (or main) ottoman member 58 and a secondary (or mid, or middle) ottoman member 60. When the ottoman is raised, as shown in FIG. 3, its members cooperate to support the backs of the user's legs, much as if the user were sitting in a contoured chaise lounge. When the chair 50 is in its TV position, the padding 62 of the seat cushion 64, padding 66 of the secondary ottoman member 60 and the padding 68 of the primary ottoman member 58 as seen in longitudinal profile, upwardly present a gentle convexity or hump, the high point of which is at or near the front edge of the seat cushion 64. Although the secondary ottoman member 60 substantially fills the gap between the front of the seat cushion and the rear of the primary ottoman, it is preferred to provide that the upholstery of the chair 50 include a two-part apron (not visible in this view), concatenated one part between the primary and secondary ottoman members, and the other between the secondary ottoman member and the front of the seat and arm frame unit, immediately under the front edge of the seat cushion.

As the user rotates the mechanism-operating handle 70 forwards and/or pulls backwards on the outer edge 72 of the primary ottoman member 58 with their heels, the ottoman 72 begins to retract towards its stored position. As this occurs, what was the upper, rear edge of the secondary ottoman member radically lowers so that the padded secondary ottoman member becomes stowed, pad facing rearwards, behind the padded primary ottoman, pad facing forwards, under the front edge of the seat cushion, in a space 74 provided at the lower front of the upholstered seat and arm frame unit. As the ottoman members and upholstered seat and arm frame unit move, the catenated aprons wrap about the secondary ottoman member, and the secondary ottoman member comes to rest stored in a "pocket" defined to the rear of the stowed primary ottoman member, between the wings 76. The secondary ottoman member 60 may itself have similar wings, which are less far apart than the wings 76, which in the FIG. 3 position curve down over and tend to veil corresponding portions of the mechanism. As the secondary ottoman member rotates for storage, its side wings, if present, rotate so as to become stowed projecting forwards, between the wings 76. (The catenated aprons are not as wide as the wings, so the wings and aprons can make their respective movements without entangling or otherwise interfering with one another.)

Second, although most readers of this document likely do not need to be told, it is worth briefly mentioning for the benefit of less familiar readers, that the operating mechanism for the chair 50, as is conventional, has left and right side linkages which are mirror images of one another, together with some transverse interconnection members which connect corresponding elements so that their movements are coordinated. A torque tube transversally extends between journals provided on respective members of the side linkages, and the operating handle secured to it as a crank. In the drawings, FIGS. 4 et seq., only one of the side linkages is depicted, namely the inboard side of the right side linkage, the inboard side of the left side linkage being a mirror image thereof. In the preferred embodiment, all transverse interconnections of the left and right side linkages, but for the torque tube, are provided by the securements of the respective portions of the side linkages to respective portions of the chair back, the upholstered seat and arm frame unit, the ottoman members, and the chair base. A rocker locking mechanism, although not shown, preferably is provided in the manner that has been described above in relation to FIG. 1. The landing gear of the lock land on transverse cross-members provided between the rails of the rocker platform rails of the chair base.

The computer-aided design and drawing system which was used to prepare FIGS. 4–14 is one which typically draws two-dimensionally without indicating which of two partially overlapping elements is, in fact, closer to the viewer. All elements are simply shown superimposed. In practice, some elements are located further inboard and others further outboard than others, and, whereas most linkage elements are generally flat, it is conventional to provide them with various bends so that they do not interfere with one another in spatial location and envelope of movement.

Chair frame parts typically are made of wood, with conventional fasteners. Upholstery is generally provided as padding made of conventional upholsterers stuffing, padding and cushion materials both of the fiber batting and foamed plastic types. Coverings typically are made of fabric, leather or artificial leather. Operating mechanism and linkages are conventionally made of stamped, punched and matte black-painted steel plate, tubing, rivets, grommets, stop pins, bushings, nut and bolt assemblies and the like. No material or technique used for making the product of the invention need be other than is typically used in the manufacture of conventional reclining chairs.

Unless otherwise indicated or made apparent, the pivot Joints on the side linkages provide transverse, horizontal axis pivots.

Particular differences which set off the preferred embodiment of the present invention from reclining chairs seeking to serve the same market, include that, upon closing of the chair 50 from the TV position, the secondary ottoman member 60 tilts radically, thereby avoiding friction against the front and underside of the seat cushion 64, coordination of the secondary ottoman member 60 with the primary ottoman member 58 is provided in part by a linkage system, separate from the side linkages, the links of which are oriented generally horizontally, rather than vertically on edge as is much more common in reclining chair operating mechanisms, and because of the provision of this separate linkage system, the side linkages themselves are less complicated which represents an advantage both from mechanical and aesthetic viewpoints.

Figure 4:
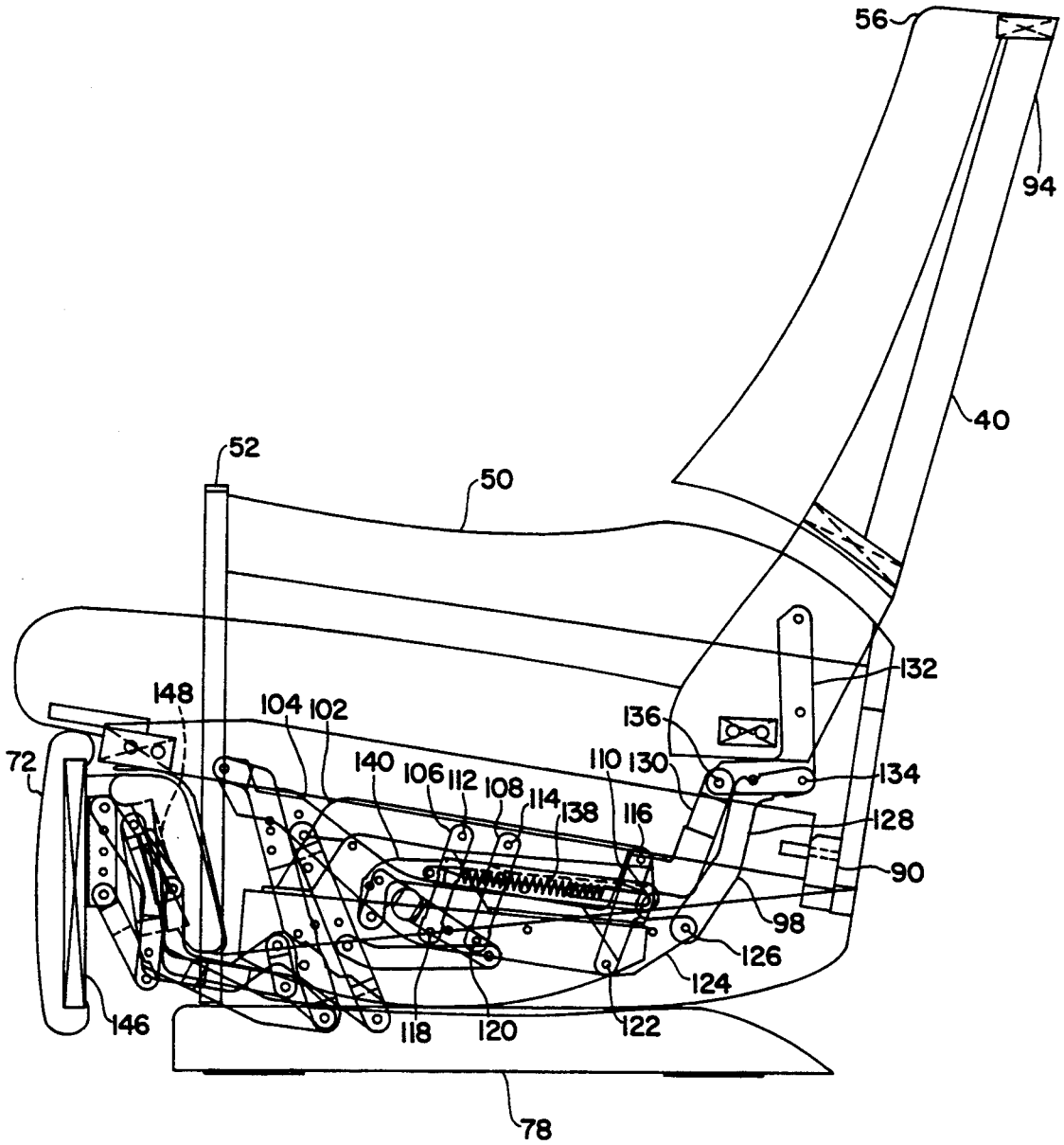
FIG. 4 is a somewhat schematic longitudinal, sectional view of a reclining chair constructed in accordance with the principles of the present invention, the various elements of the mechanism being depicted as if transparent (so that ones actually located behind others in the direction of view are not thereby obscured), the chair being shown in the fully erect (closed) position thereof.
Figure 5:
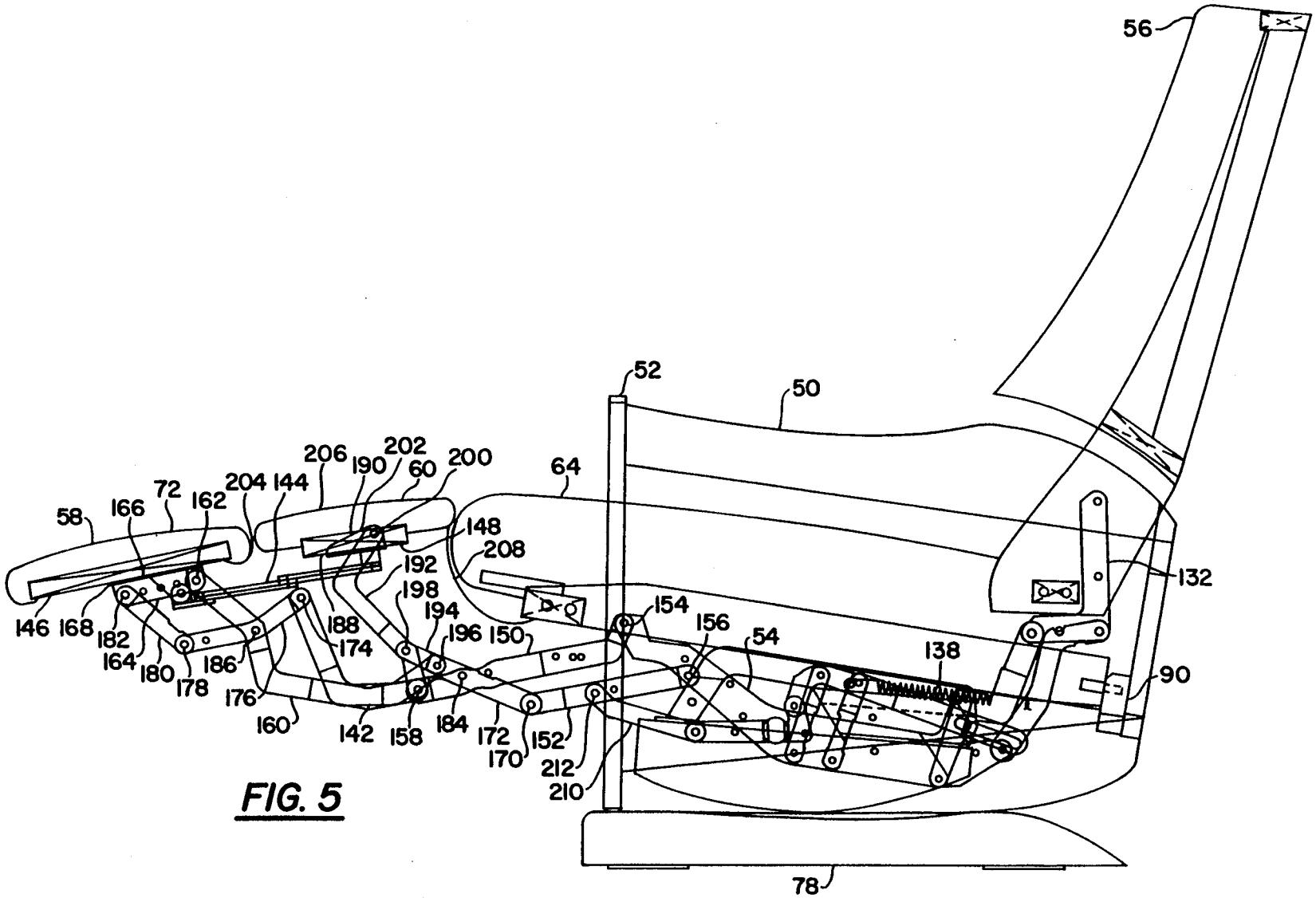
FIG. 5 is a view similar to FIG. 4, showing the chair in the TV position thereof.
Figure 6:
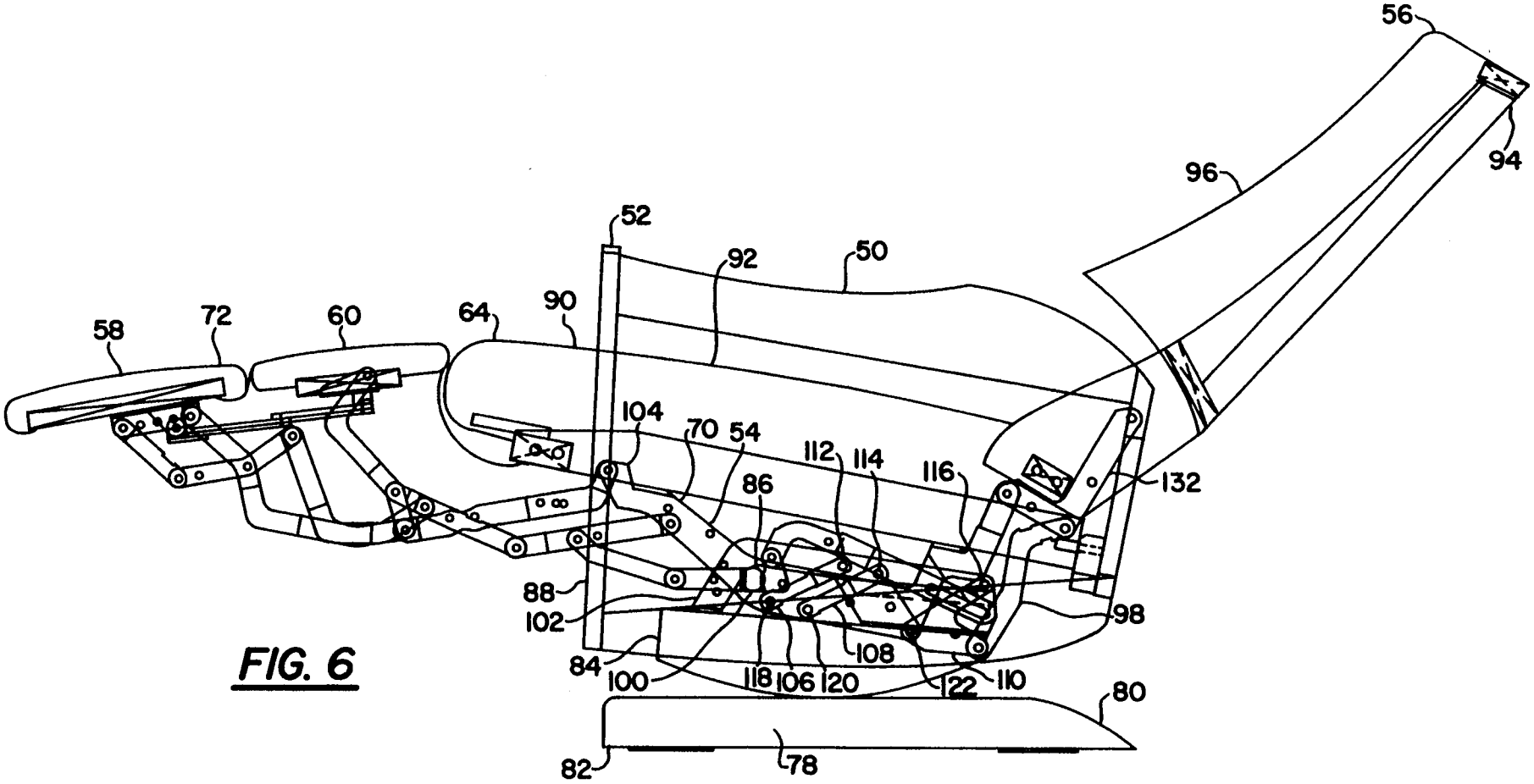
FIG. 6 is a view similar to FIG. 5, showing the chair in the fully reclined (fully open, fully laid-out) position thereof.
Figure 7:
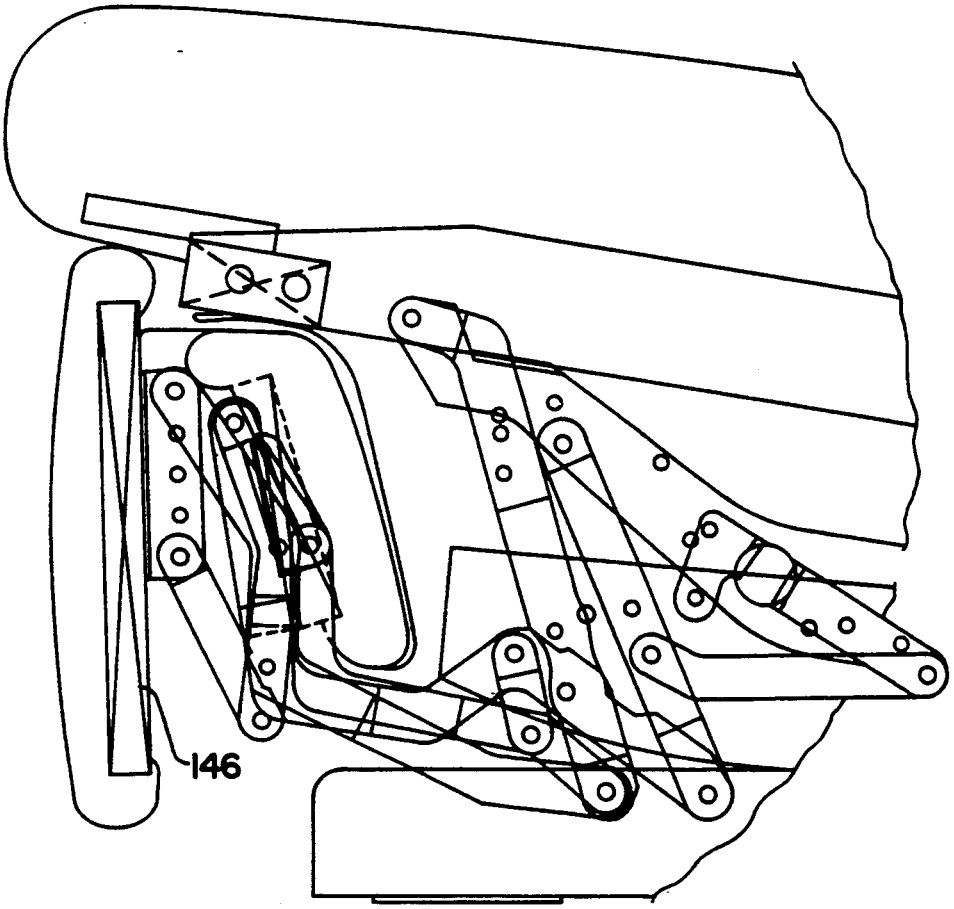
FIG. 7 is a larger scale fragmentary longitudinal sectional view of a portion of the structure shown in the FIG. 4 position thereof.
Figure 8:
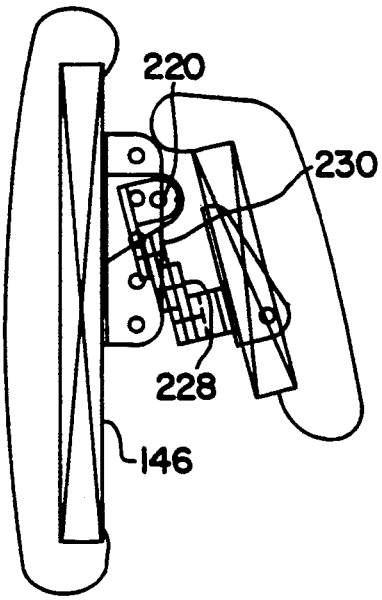
FIG. 8 is a view similar to FIG. 7, with side linkage elements omitted.

FIGS. 4, 5 and 6, respectively, show the chair 50 of FIG. 3, somewhat schematically, in longitudinal vertical section, respectively in fully erect (closed), TV, and fully reclined (open) position. Although relative movement of the chair elements can be best seen by looking at FIGS. 4, 5 and 6, in succession, the individual links of the mechanism, and their interconnections are believed to best show in FIG. 6 (and in FIGS. 7–14), where they are less overlapped.

The chair 50 is seen to include a base 78, which, in this instance, comprises a floor-supported platform 80 with longitudinal rails 82 on which a rocker 84 is mounted for forward and back rocking. Conventional counterbalance springs (not shown) are preferably mounted between the rocker 84 and platform 80 for maintaining the base 78 in an assembled condition and tending to maintain the rockable part of the chair at a datum position midway between a rocked forwards position and a rocked rearwards position. The platform 80 also includes front and rear transverse members (not shown), the upper surfaces of which provide landing surfaces for the conventional rocker-blocking landing gear which preferably forms a part of the chair operating mechanism 54. (As the operating handle 70 is rotated in a sense to raise and extend the ottoman, from the FIG. 4 position to the FIGS. 3 and 5 position, the retracted landing gear, which is operatively connected to the rotatable torque tube 86 to which the handle 70 is mounted, lowers onto the landing surfaces of the transverse members of the platform, forwardly and rearwardly of the counterbalancing springs, generally along the longitudinal centerline of the chair, for using purchase against transverse members of the rocker, to which the landing gear is secured, for preventing rocking of the rocker with respect to the platform. The rocker-blocking landing gear thereby provides a predetermined spatial relation of the rocker to the platform (which is usually selected by the manufacturer to be a slightly rocked-back orientation, partly to provide a desired rearward shift in the center of gravity of the seated user, and partly to prevent the user from driving the lower edge of the primary ottoman into the floor, should the user lean forwards while rotating the operating handle from the FIG. 4 position thereof to the FIGS. 3 and 5 position thereof).

The upholstered seat and arm frame unit is indicated at 52. Its left and right arm portions 88 extend outboard of the rocker 84 and rails, veiling much of those structures from view. The unit 52, in addition to including several longitudinally extending frame members, includes transverse extending frame members and transversally extending frame members, all connected together to provide a rigid frame, which includes a seat frame portion 90 extending between the arm portions intermediate the vertical extent of the arm portions. The unit 52 is padded and upholstered (as best shown in FIG. 3) by stuffing and batting, covered by upholstery 92, including a seat cushion 64 (which, in the preferred embodiment, is a tight cushion, meaning that it is held in place by being secured to other portions of the upholstery and to the frame, rather than being freely removable).

The operating mechanism 70 is mounted on the rocker 84 of the base 78, and the upholstered seat and arm frame unit 52 is mounted on the operating mechanism 70. Thus, the operating mechanism supports the upholstered seat and arm frame unit 52 on the base 78.

The chair back 56, which includes a frame 94 of interconnected longitudinal and transverse members, stuffing, padding and upholstery 96 also is mounted to the mechanism 54 to be interactively supported thereby. Transverse elements of the chair back, in effect, interconnect corresponding left and right side linkage elements of the mechanism 54, as do corresponding transverse elements of the upholstered seat and arm frame unit 52, the primary ottoman 58 and the secondary ottoman 60.

In the particular embodiment depicted, the operating mechanism 54 is not a unitary member until its subassemblies are assembled to one other on the chair. (This is conventional, as is another type of mechanism (not shown), which is preassembled as a unitary structure which is installed as a unit as the chair is being preassembled.) Alternatively, the operating mechanism could be provided as such a preassembled structure. Except for the ottoman mounting linkage subassemblies that will be described in greater detail below, the structure and function of the mechanism 54 as shown and described should be understood as being representative or typical. There is nothing else about it which is believed to be noteworthy. It is made conventionally of conventional materials, and conventionally mounted to the chair components for conventional operation.

Apart from the rocker-blocking landing gear, which has been described above (and various nonshown helper and tensioning springs, which may be conventionally provided for tending to keep the mechanism in a desired position, prevent the weight of the chair back and ottoman from tending to open up the chair from its closed to its TV or from its TV to its open position and fasteners for securing the mechanism to the respective chair components), the mechanism 54 principally includes left and right side linkages 98, and the torque tube 86, on one end of which the operating handle 70 is mounted. The transversally oriented torque tube 86 is journalled for rotation in grommeted openings 100 in two corresponding elements of the left and right side linkages 98 which are fixed in spatial relation to the upholstered seat and arm frame unit. Thus, one end portion of the torque tube extends outboard of the respective (preferably right) side linkage 98, and out through an opening provided in the upholstery 92 on the corresponding arm 88 of the chair. Externally of the upholstery, beside this arm of the chair, the operating handle 70 is mounted on the corresponding end of the torque tube 86.

Constraints conventionally provided by the geometry of the interpivoted links of the mechanism 54 prevent the chair back from being reclined from the FIG. 4 fully erect position thereof, unless and until the handle 70 has been rotated from its FIG. 4 position to its FIGS. 3 and 5 position (in the course of fully extending the ottoman from its fully retracted position). Likewise, should a user occupying the chair 50 in its FIG. 6 fully open (fully reclined) position wish to retract the ottoman from the FIGS. 3 and 5 to the FIG. 4 position thereof, the user must first, as they reach for the operating handle, shift some of their weight off of the chair back and onto the chair seat, thereby causing the mechanism to operate in a sense which lowers the seat and arm frame unit 52 relative to the base 78, and pivots the chair back 56 up from its fully reclined position of FIG. 6, to its fully erect position of FIGS. 3 and 5.

Each side linkage of the operating mechanism 54 is shown including a first longitudinal long link 102 by which the operating mechanism is mounted on the rocker 84 of the base 78. A respective second longitudinal long link 104 mounts each side linkage 98 to the seat frame portion 90 of the seat and arm frame unit 52. The link 104 is disposed outboard of the link 102 on each side linkage 98. Front, middle and rear suspending links 106, 108 and 110, pivotally joined at their upper ends (at 112, 114, 116) and lower ends (at 118, 120, 122) respectively to the respective first and second long links 102 and 104 in effect hangingly suspend the upholstered seat and arm frame unit 52 from the rocker 84 of the base 78.

The grommeted openings 100 in which the torque tube 86 is journalled for rotation about its own transversally oriented horizontal axis, are provided at respective transversally aligned locations in the second longitudinal long links 104 of the left and right side linkages.

The rear links 110 are shown being V-shaped, so that each has a rearwardly, upwardly projecting spur 124, the upper end of which is pivoted at 126 to the lower end of a respective chair back driving link 128. Each second longitudinal long link 104, at its rear end, also is provided with an integral, upwardly, rearwardly projecting spur 130. Each side linkage 98 is shown further including a forwardly facing L-shaped chair back mounting link 132 to which the frame 94 of the chair back 40 is (preferably removably) secured, for articulatingly mounting the chair back relative to the upholstered seat and arm frame unit, to the rocker 84 of the base 78. The back frame 94, at its left and right, secures to the upper leg of the respective L-shaped links 132. Where the upper and lower legs of each link 132 intersect, a pivot joint 134 is provided, by which the links 132 are pivotally connected with the upper, rear ends of the respective chair back driving links 128. The forward end of the lower leg of each L-shaped link 132 is pivotally joined at 136 to the upper end of a respective spur 130.

Accordingly, when the chair back is reclined from the TV position to the fully reclined position (FIG. 5 and FIG. 6), the L-shaped links 132 cock, causing the seat and arm frame unit to elevate by swinging the links 104 on the links 102 by pivotal rotation of the links 106, 108, 110. This action stores energy which is used for recovering the chair and occupant combination from the FIG. 6 to the FIG. 5 position, as the user shifts his or her weight forwards and down onto the seat, away from the back, so that the back will rotate up as the seat and arm frame unit and back together lower relative to the rocker.

A tension coil spring 138 effectively provided on a helper spring linkage 140 for one side linkage between the rear of the respective first longitudinal link 102 and the torque tube 86 is stretched and thereby stores energy as the handle 70 is rotated to store the ottoman (from the FIGS. 3 and 5 to the FIG. 4 position); a similar spring and linkage 138, 140 is provided for the other side linkage between the rear of the seat frame 90 and the torque tube 86, also to be stretched and store energy as the ottoman is retracted. These springs and stored energy tend to help to maintain the stowed primary ottoman tight against the front of the seat and arm frame unit until the handle begins to be rotated for extending the ottoman, whereupon they tend to help the user to accelerate the pantographic linkage and ottoman from their FIG. 4 position towards their FIGS. 3 and 5 positions. This usage of helper springs is generally conventional for ottomans of recliner chairs.

The really unique aspects of the chair 50 and its mechanism 54 center upon details of the ottoman 72 and how its members 58, 60 are supported and articulated, which will now be explained in further detail.

The ottoman 72 is indirectly mounted to the seat and arm frame unit of the chair by being mounted on pantographic linkage subassemblies 142 which form respective portions of the left and right side linkages 98 of the mechanism 54. In addition, the secondary ottoman member 60 is connected to the primary ottoman 58, so as to receive control therefrom, by a believed-novel auxiliary control mechanism 144. The auxiliary control mechanism 144 of the preferred embodiments is mounted generally medially of the chair, or at comparable locations to the left and right of the median, but separate from, and located inboard of, the side linkages 98.

The pantographic linkage subassemblies 142 are mostly unremarkable but for their simplicity, and the ways that some of the links are angled in facial profile, so that when in the FIG. 4 position, they align to form respective portions of a pocket for the secondary ottoman 60 behind the primary ottoman 58. The board 146 of the primary ottoman is wider (widthwise of the chair) than is the board 148 of the secondary ottoman. The respective brackets of the pantographic linkage subassemblies 142 mount to the back of the board 146 at two widely, oppositely laterally spaced locations which are nevertheless located inboard of the ends of the board 146, and to the opposite ends of the board 148. All of the respective subassemblies 142 but for the respective mounting brackets for the board 148 are located outboard of the respective ends of the board 148.

Each pantographic linkage subassembly 142 is shown including upper and lower rear links 150, 152 having their respective upper ends pivoted at 154 and 156 to the upper, front end of the second longitudinal long link 104, and to a somewhat further back, lower site on the same link 104. The forward end of the upper rear link 150 is pivoted at 158 to the lower rear end of an upper forward link 160, the forward end of which is pivoted at 162 to the upper-rear of the longitudinal flange 164 of the L-shaped bracket 166. The back rear of the board 146 of the primary ottoman member 58 is secured to the medially directed flange 168 of the bracket 166. The forward end of the lower rear link 152 is pivoted at 170 to the rear end of the rear-intermediate link 172. The forward end of the rear-intermediate link 172 is pivoted at 174 to the rear end of a forward-intermediate link 176. The forward end of the link 176 is pivoted at 178 to the lower, rear end of a lower forward link 180, the forward end of which is pivoted at 182 to the lower forward end of the longitudinal flange 164 of the L-shaped bracket 166. The links 150 and 172 are effectively pivoted to one another at respective intermediate sites where they cross past one another, at 184. Likewise, the links 160 and 176 are effectively pivoted to one another at respective sites where they cross past one another, at 186.

The left and right ends of the board 148 of the secondary ottoman are mounted to the rear, medially directed flanges 188 respective, facing L-shaped brackets 190. The longitudinal flanges 202 of the brackets 190 embrace the secondary ottoman board 148 between them. On each side linkage, a support link is provided, having its lower end joined to the respective pantographic linkage subassembly at the respective pivot joint 158, and is operated by a driving link 194 which has a rear end pivotally connected at 196 to the link 172 at an intermediate location on that link, and its forward end pivoted at 198 to the link 192 at an intermediate location on that link.

The forward, upper end of each link 192 is pivoted at 200 to the longitudinal flange 202 of a respective bracket 190.

Were it not for the auxiliary control mechanism 144, the secondary ottoman member 60 would be pivotally rockable on the pivots 200, limited only by the forward, upper apron of upholstery material 204 which hangingly extends in a first catenary between the upper rear of the back of the primary ottoman board to which it is secured, e.g., by a row of upholsterer's staples, and the forward edge of the stuffed upholstered pillow or cushion 206 which is mounted on the front, leg supporting side of the board of the secondary ottoman member, e.g., by sewing, and by the rear, lower apron of upholstery material 208 which hangingly extends in a second catenary between the rear edge of the pillow 206 and the seat frame 90, below and behind the front edge of the seat cushion 64, respectively by sewing and a row of upholsterer's staples.

The fact that the pillow 206 extends laterally beyond the secondary ottoman board, over the side linkages, helps to veil the side linkages from view when the ottoman is in an extended condition.

As the operating handle 70 is manually rotated, the pantographic linkage subassemblies are caused to extend (as the handle is rotated in the FIG. 4 to FIGS. 3 and 5 sense) and to retract (as the handle is rotated in the FIGS. 3 and 5 to FIG. 4 sense), by a driving link 210 of each side linkage, having its forward end pivoted at 212 to the respective link 152 at an intermediate location on that link, and its rear end pivoted at 214 to the radially outer end of a respective crank link 216 secured on the torque tube 86.

The side linkages may further include stop pins, helper springs and similar conventional features which, if shown, have not been discussed in detail herein, for performing usual functions in usual ways.

Control of the angular orientation of the secondary ottoman member 60 while it is deployed, and while the ottoman is being extended and retracted, is provided by the auxiliary control mechanism 144.

A first preferred embodiment of the auxiliary control mechanism 144 is shown in FIGS. 4–10. In this embodiment, the mechanism 144 includes a first bracket 218, medially mounted to the back of the board of the primary ottoman member 58, which provides a transverse horizontal axis pivot joint 220, and a second bracket 222, medially mounted to the back of the board 148 of the secondary ottoman member 60, which provides a pivot joint 224 having its axis normal to the plane of the board 148. The pivot joint 220 mounts to the longitudinal flange of an L-bracket, the transverse flange of which is provided medially of the chair with a pivot joint 226 having its axis normal to the pivot joint 220 and, in use, normal to the plane of the board 148 (i.e., parallel to the pivot joint 224). The pivot joints 224 and 226 are coordinated in order to maintain them parallel to one another while moving away from one another along the median of the chair as the ottoman is extended, and towards one another along the median as the ottoman is retracted and stowed, by an appropriate linkage means. In the first preferred embodiment, that linkage means is shown being provided by four links, arranged in two pairs including a rear link 228 having its rear end effectively pivoted to the board of the secondary ottoman member by the pivot joint 224, a forward link 230 having its forward end effectively pivoted to the board of the primary ottoman by the pivoted joint, and a pivot joint 232 (also having its axis parallel to the joints 224 and 226) by which the forward end of the rear link 228 is pivoted to the rear end of the forward link 230. In the embodiment depicted, the two articulated struts provided by the two link pairs 228, 230, are arranged to buckle outwards at their intermediate joints 232.

In the stowed condition, the secondary ottoman member is stored board-forwards and pillow rearwards in the pocket behind the primary ottoman member, which is stored board-rearwards and pillow forwards, with its lateral wings projecting rearwards veiling the ends of the secondary ottoman member from view. At this time, the linkage means 228, 230, etc., faces the board 146 of the primary ottoman member. As the ottoman is deployed by rotating the operating handle 70, the scissors, jack-like means 228, 230 opens up, being pulled by the two pivotal connections 220 and 226. As the ottoman is stowed by reversely rotating the operating handle 70, the scissors, jack-like means 228, 230 collapses, being pushed by the two pivotal connections 220 and 226.

It should be noticed that each of the links 192, 160 and 172 (the first-mentioned of which is most medial and the last-mentioned of which is most lateral on each of the side linkages) is provided at a comparable location along its length as seen in side elevation, with an angulation (i.e., a bend or crook) 232 all of which align in the FIG. 4 position of the chair to provide a corresponding part of the pocket in which the secondary ottoman member 60 is stowed behind the primary ottoman member.

Nevertheless, the ottoman deploys along a smooth arc as the operating handle is turned from the FIG. 4 position thereof to the FIGS. 3 and 5 position thereof. It should be noticed that the collective support means provided by the seat cushion secondary ottoman pillow and primary ottoman pillow when the chair is in the FIGS. 3, 5 and 6 positions thereof is substantially continuous as a gentle upwardly convex arc as seen in side elevation or longitudinal section. Stated another way, when the ottoman is in its extended condition, the secondary ottoman member is disposed high enough to provide support to the overlying portion of the user's legs, and there are no substantial gaps in support between the seat and secondary ottoman member or between the secondary ottoman member and the primary ottoman member.

FIGS. 11 and 12, and FIGS. 13 and 14, respectively, fragmentarily show a second and a third preferred embodiment of the reclining chair of the present invention. All of what is disclosed above in relation to the embodiment shown in FIGS. 3–10, is also applicable to the embodiments shown in FIGS. 11–14, except that the details of the structure (but not the intended manner and results of operation) of the auxiliary control mechanism 144 are different.

Figure 10:
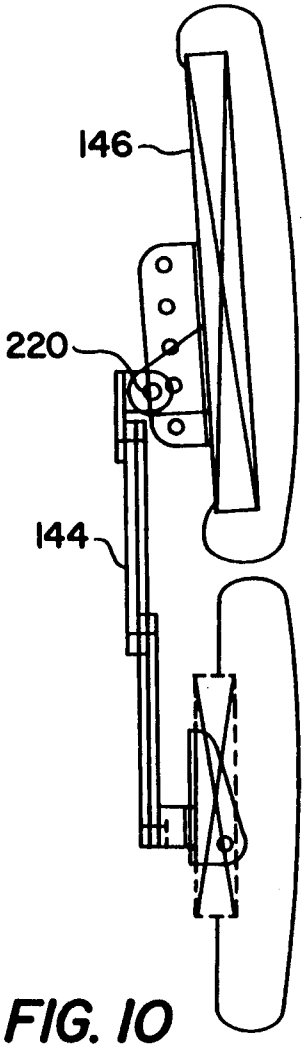
FIG. 10 is a fragmentary longitudinal, sectional view of the structure of FIG. 9.
Figure 12:
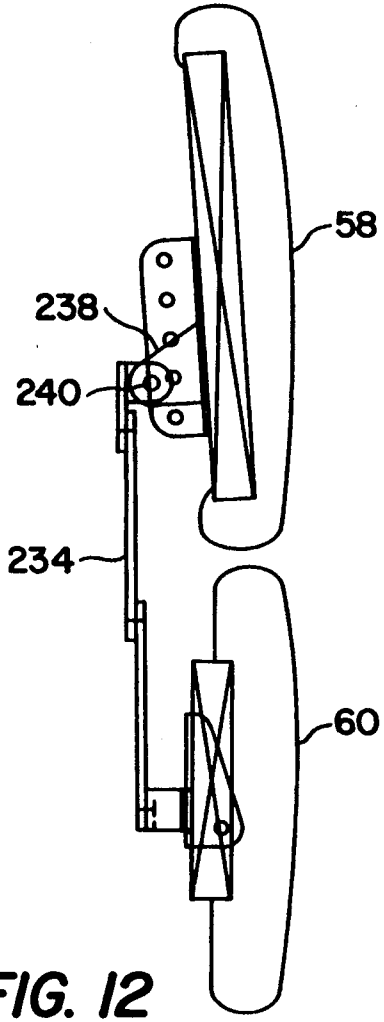
FIG. 12 is a fragmentary longitudinal sectional view thereof.
Figure 11:
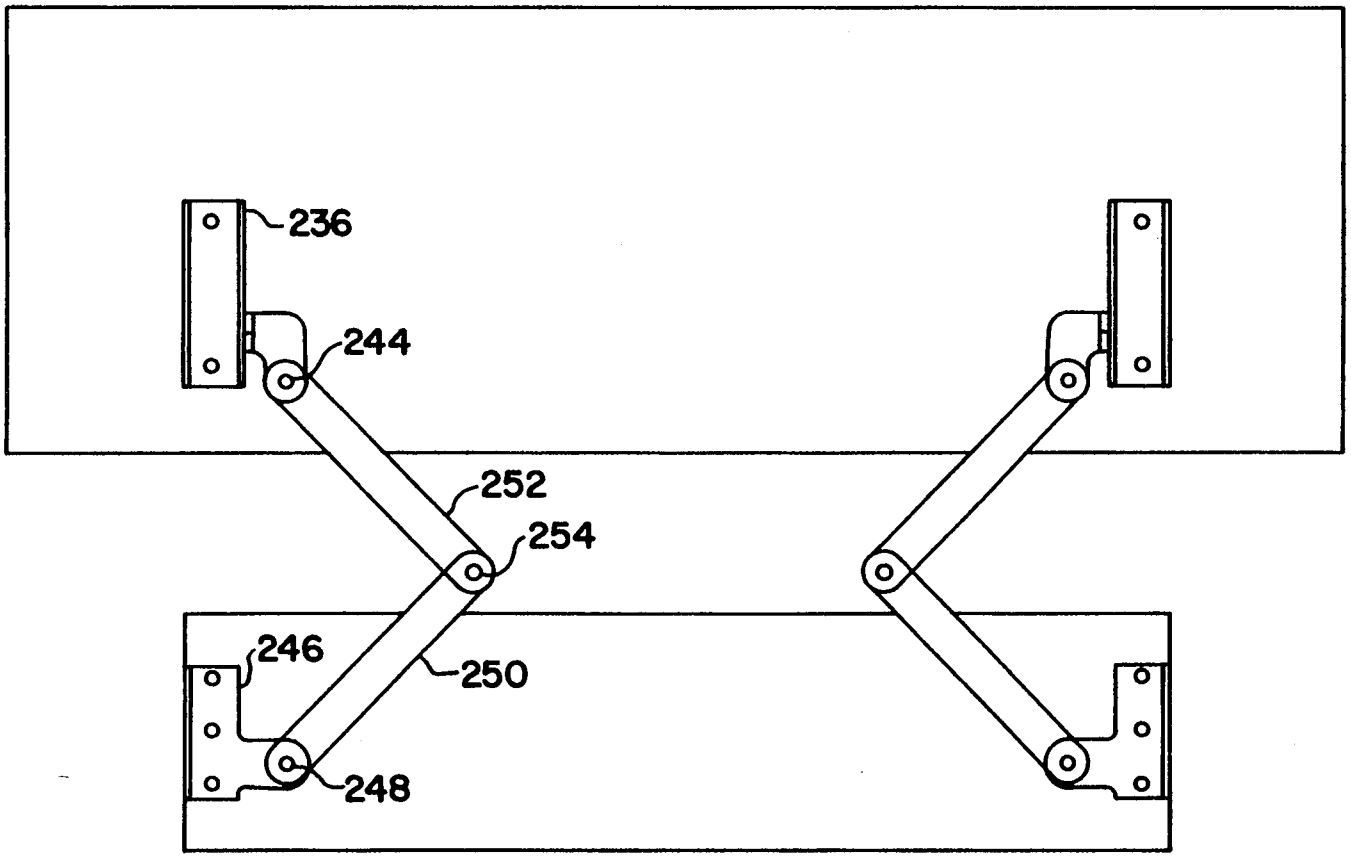
FIG. 11 is a fragmentary bottom plan view of the ottoman according to a second embodiment.

In the embodiment of FIGS. 11 and 12, the auxiliary control mechanism of FIGS. 3–10 has been, in effect, longitudinally split down the middle into two structures 234, the left one of which has been shifted rightwards laterally beyond the one at the right, and vice versa.

Figure 9:
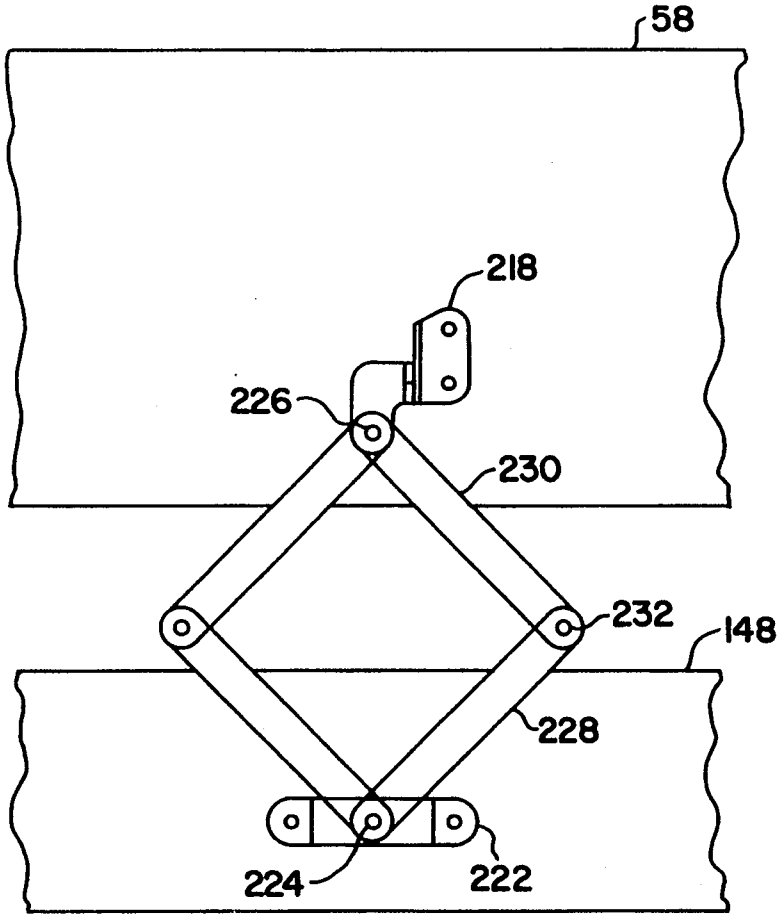
FIG. 9 is a fragmentary bottom plan view of the ottoman shown in a position corresponding to that of FIGS. 5 and 6.

FIGS. 11 and 12, respectively, compare to FIGS. 9 and 10. The primary ottoman member is depicted at 58 and the secondary ottoman member is depicted at 60. Brackets 236 are fixedly mounted to the back of the board of the primary ottoman member. Their longitudinal flanges 238 have transverse, horizontal axis pivot joints 240 connecting to L-brackets 242, which provide normal axis pivot joints 244. Brackets 246 fixedly mounted to the back of the board of the secondary ottoman member provide normal axis pivot joints 248. Articulated struts are provided, each having a rear end of a rear link 250 connected to the respective pivot joint 248, a forward end of a front link 252 connected to the respective pivot joint 244, and having the forward end of its rear link pivotally connected to the rear end of its front link at a respective normal axis pivot joint 254. Operation of this embodiment is substantially the same as the one shown in FIGS. 3–10 (except that the "knees" at 254 buckle towards, rather than away from, one another as the chair moves from the FIGS. 3 and 5 position to the FIG. 4 position thereof).

Figure 14:
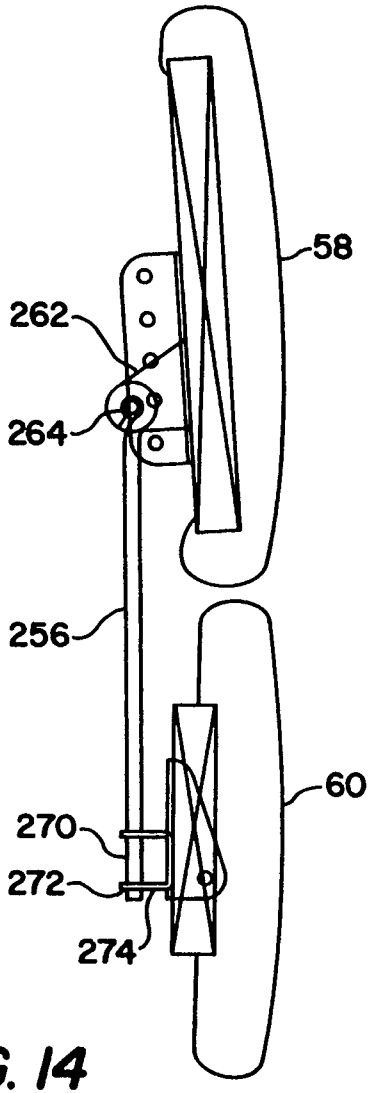
FIG. 14 is a fragmentary longitudinal, sectional view thereof.
Figure 13:
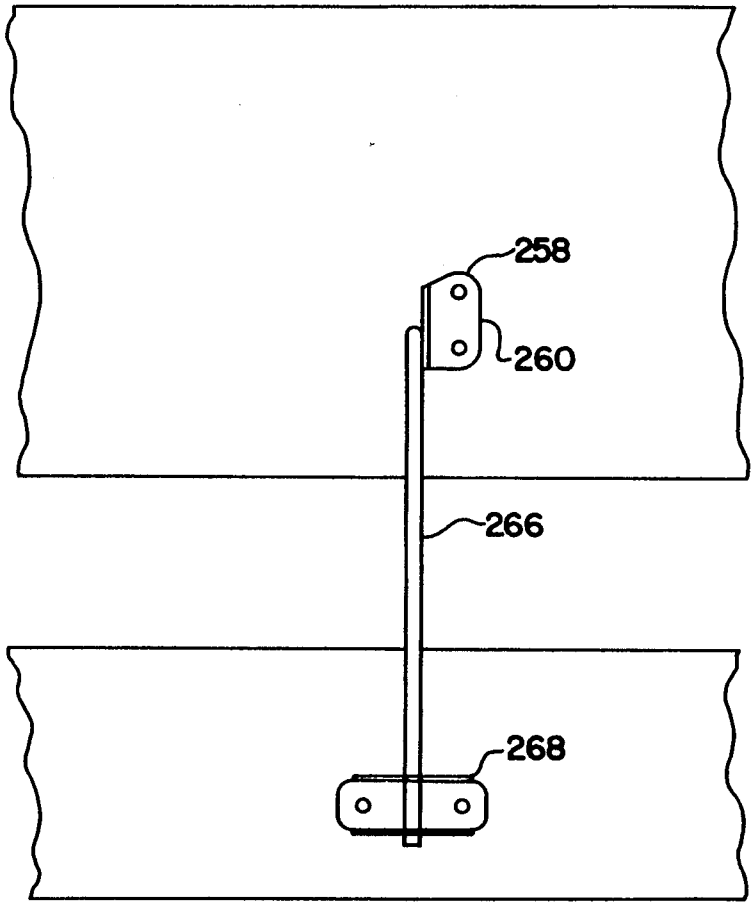
FIG. 13 is a fragmentary bottom plan view of the ottoman according to a third embodiment.

The third embodiment of the auxiliary control mechanism, shown at 256 in FIGS. 13 and 14, is structured more differently than the first two are from one another, but substantially provides the same effect. In this embodiment, an L-bracket 258 has its transverse flange 260 medially secured on the back of the board of the primary ottoman member 58. Its longitudinal flange 262 provides a transverse, horizontal axis pivot joint 264 for a front end of a rigid tilt rod 266. A U-shaped bracket 268 medially secured on the back of the board of the secondary ottoman member 60 provides a slide yoke for the shank or tail 270 of the rod 266, by having holes 272 provided in line with one another along the median of the chair, through the outstanding transversally extending forward and rear flanges 274 of the bracket 268. The fit of the shank 270 in the openings 272 is loose enough to permit free sliding, but tight enough to prevent tilting of the rod relative to the secondary ottoman. The shank is long enough that it does not pull out of the openings 272 when the primary ottoman member moves its furthest away from the secondary ottoman member, i.e., as the chair moves from the FIG. 4 position thereof to the FIGS. 3 and 5 position thereof.

It should now be apparent that the reclining chair with articulating linkage for padded intermediate ottoman as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is Claimed is:

1. A reclining chair comprising:

a base for supporting the reclining chair on a floor;

an upholstered seat and arm frame unit comprising a generally horizontal seat frame supporting a seat cushion having a front edge;

a recliner mechanism of assembled elements, including a left side linkage, a right side linkage, and a transversally horizontally extending torque tube journalled on respective ones of said elements of said left and right side linkages for rotation about its own longitudinal axis;

corresponding ones of said elements of said left and right side linkages being mounted to said seat and arm frame unit, and to said base, for mounting said seat and arm frame unit on said base;

said left and right side linkages each including pantographic linkage subassemblies arranged to extend forwardly and upwards relative to said base to an extended position when said torque tube is rotated about said axis in one angular direction, and to retract downwards and rearwardly to a stowed position adjacent said base and below said front edge of said seat cushion;

a primary ottoman member mounted to corresponding elements of said pantographic linkage subassemblies of said left and right side linkages, which elements are located most distant from said base upon extension of said pantographic linkage subassemblies to said extended position;

a secondary ottoman member mounted to corresponding elements of said pantographic linkage subassemblies of said left and right side linkages, which elements are located intermediate said base and the pantographic linkage subassembly elements on which said primary ottoman member is mounted, said secondary ottoman member being rotatable about a transversally extending horizontal axis relative to the pantographic linkage subassembly elements on which said secondary ottoman member is mounted;

said primary ottoman including a board which is padded on one side, which side is presented generally upwards when said pantographic linkage subassemblies are disposed in said extended position, and is presented generally forwards when said pantographic linkage subassemblies are disposed in said stowed position;

said secondary ottoman member including a board which is padded on one side; and an auxiliary control mechanism mounted to said board of said primary ottoman member and to said board of said secondary ottoman member and arranged to constrain spatial orientation of said secondary ottoman member relative to said transversally extending horizontal axis about which said secondary ottoman member is rotatable to an arc arranged so that said secondary ottoman member is disposed with said padded side thereof presented generally upwards when said pantographic linkage subassemblies are disposed in said extended position, and is disposed ranked closely behind said primary ottoman member and with said padded side presented thereof generally vertical when said pantographic linkage subassemblies are disposed in said stowed position.

2. The reclining chair of claim 1, further including:

a first apron of upholstery material catenated between said primary ottoman member and said secondary ottoman member; and a second apron of upholstery material catenated between said secondary ottoman member and said seat frame adjacent said front edge of said seat cushion.

3. The reclining chair of claim 1, wherein:

said seat and arm frame unit includes left and right arm portions which extend downwards below said front edge of said seat cushion left and right of said seat frame; and said primary ottoman member includes wing portions provided at left and right ends of said board of said primary ottoman member; said wings, when said pantographic linkage subassemblies are in said stowed position thereof extending rearwardly from said board of said primary ottoman member respectively into confronting proximity with said left and right arm portions of said seat and arm frame unit.

4. The reclining chair of claim 3, wherein:

said secondary ottoman member is padded on said one side thereof by having a pillow upholstered thereto, said pillow extending leftwardly and rightwardly beyond respective ends of said board of said secondary ottoman member and overhanging respective portions of said pantographic linkage subassemblies when said pantographic linkage subassemblies are disposed in said extended position thereof.

5. The reclining chair of claim 4, wherein:

said board of said primary ottoman member, said wings of said primary ottoman member and at least three link elements of each of said pantographic linkage subassemblies cooperatively define among themselves when said pantographic linkage subassemblies are disposed in said stowed position thereof a pocket in which said secondary ottoman member is stowed.

6. The reclining chair of claim 1, wherein:

said auxiliary control mechanism includes:

at least one bracket secured to said board of said primary ottoman member;

at least one bracket secured to said board of said secondary ottoman member;

transverse, horizontal axis pivot joint providing means mounted to said at least one bracket secured to said board of said primary ottoman member, and longitudinal lost motion-providing guide means mounted to said at least one bracket secured to said board of said secondary ottoman member and constrained thereby to move generally parallel to said board of said secondary ottoman member, and being connected at an end thereof to said transverse, horizontal axis pivot joint-providing means.

7. The reclining chair of claim 6, wherein: said auxiliary control mechanism is located more medially of said chair than said pantographic linkage subassemblies.

8. The reclining chair of claim 1, wherein:

said left and right pantographic linkage subassemblies are arranged to extend and retract upon rotation of said torque tube in respective angular directions by being operatively pivotally connected to said torque tube by respective driving links pivotally connected to respective crank links secured to said torque tube.

9. The reclining chair of claim 8, wherein:

said torque tube has an operating handle secured on one end thereof, wherewith said torque tube is reversibly rotatable.

10. The reclining chair of claim 9, further including:

an upholstered chair back mounted to said mechanism for movement between a rearwardly reclined position and an erect position when said left and right pantographic linkage subassemblies are in said extended position thereof.

11. The reclining chair of claim 1, wherein:

when said left and right side linkages are in said extended position, said seat cushion, said secondary ottoman member and said primary ottoman member collectively upwardly present a gentle convexity having a high point which is located at or near said front edge of said seat cushion.

* * * * *